US007114706B1

(12) United States Patent
Bemis et al.

(10) Patent No.: US 7,114,706 B1
(45) Date of Patent: Oct. 3, 2006

(54) FRAME FOR MOUNTING A GATE ON A SLOPE

(75) Inventors: Jeff Bemis, Masarkytown, FL (US); William Woodard, New Port Richey, FL (US); Dan Perry, Wilmington, NC (US)

(73) Assignee: Alumi-Guard, Inc., Hudson, FL (US)

( * ) Notice: Subject to any disclaimer, the term of this patent is extended or adjusted under 35 U.S.C. 154(b) by 82 days.

(21) Appl. No.: 10/815,592

(22) Filed: Apr. 2, 2004

(51) Int. Cl.
*E04H 17/16* (2006.01)

(52) U.S. Cl. ..... 256/73; 256/24; 256/65.01; 256/65.03

(58) Field of Classification Search ..... 256/24, 256/19, 55, 73, 65.01, 65.03, 65.11, 65.12; 52/455, 801.1; 49/501
See application file for complete search history.

(56) References Cited

U.S. PATENT DOCUMENTS 3,801,072 A * 4/1974 Newberry, Jr. ..... 256/19
4,174,096 A * 11/1979 Campbell ..... 256/24
4,690,440 A * 9/1987 Rogers ..... 292/54
4,871,203 A * 10/1989 Rogers ..... 292/238
5,161,783 A * 11/1992 German ..... 256/19
5,702,090 A * 12/1997 Edgman ..... 256/19
5,716,041 A * 2/1998 Groves ..... 256/73
5,868,382 A * 2/1999 Groves ..... 256/73
6,017,019 A * 1/2000 Erwin ..... 256/65.05
6,131,888 A * 10/2000 Brown ..... 256/65.03
6,176,043 B1 * 1/2001 Gibbs ..... 49/501
6,398,193 B1 * 6/2002 DeSouza ..... 256/19
6,443,088 B1 * 9/2002 Putman et al. ..... 114/343
6,499,725 B1 * 12/2002 Meis et al. ..... 256/65.03
6,751,906 B1 * 6/2004 Bass ..... 49/387
6,827,336 B1 * 12/2004 Hwang ..... 256/24

* cited by examiner

*Primary Examiner*—Daniel P. Stodola
*Assistant Examiner*—Nahid Amiri
(74) *Attorney, Agent, or Firm*—Stanley M. Miller

(57) ABSTRACT

A frame for bracing a gate includes a first and second upright brace having respective outboard edges positioned flush to opposite vertical edges of the gate. First upper and lower cross braces have respective opposite ends received within upper and lower ends of the first and second upright braces. Second upper and lower cross braces respectively have opposite ends abutting upper and lower ends of the first and second upright braces. First and second upper mounting members respectively have outboard ends abutting upper ends of the first and second upright brace member and inboard ends secured to the first and second upper cross braces. First and second lower mounting members respectively have bases abutting lower ends of the first and second upright braces and inboard ends secured to the first and second bottom cross braces. The structure enables mounting of a gate on a non-level surface.

10 Claims, 4 Drawing Sheets

FRAME FOR MOUNTING A GATE ON A SLOPE

BACKGROUND OF THE INVENTION

1. Field of the Invention

This invention relates, generally, to gates. More particularly, it relates to gate frame that enables mounting of a gate on a slope.

2. Description of the Prior Art

Conventional gates are designed to be mounted on level ground. Problems appear when the terrain requires that a gate be mounted on a slope.

The standard way of mounting a gate on a slope is to use a gate made of a plurality of vertically oriented slats that may slide at least to some extent with respect to one another and to deform the gate until it fits the slope. For example, the free, swinging end of such a gate may be elevated relative to the hinged end thereof so that the hinged end may be mounted to a gate post at a first level and so that the free end is free to swing at a second level that is elevated with respect to the first level. In the alternative, the free end may be positioned at a lower elevation than that of the first end.

When this method is used, a way must be found to maintain the free end of the gate at its raised or lowered elevation relative to the hinged end. Typically, a board or two is nailed to the gate in an effort to maintain the gate in its distorted configuration. This is a haphazard technique, however, and provides inconsistent results.

What is needed, then, is a structure that consistently maintains the structure of a gate where a second, free end thereof is elevated above or below a first, hingedly mounted end thereof. The needed structure should be easy to use and should provide consistent results.

However, in view of the prior art considered as a whole at the time the present invention was made, it was not obvious to those of ordinary skill in the pertinent art how such a structure could be provided.

SUMMARY OF THE INVENTION

The long-standing but heretofore unfulfilled need for a structure that supports a gate when mounted on a slope is now met by a new, useful, and nonobvious invention.

The novel frame for bracing a gate includes first and second upright braces having respective outboard edges positioned flush to opposite vertical edges of the gate.

In a first embodiment, openings are formed in the inboard sides of the first and second upright braces, at their respective upper and lower ends. A first upper cross brace and a first lower cross brace, both of which are preferably formed of aluminum, have opposite ends disposed within said openings. Thus, the first upper and lower cross braces have a common length substantially equal to the width of the gate.

In a second embodiment, the first upper cross brace and the first lower cross brace, both of which are preferably formed of aluminum, have opposite ends abutting the upper and lower ends of the first and second upright braces, respectively.

A second upper cross brace and a second lower cross brace, both of which are preferably formed of wood, have opposite ends abutting upper and lower ends of the first and second upright braces, respectively.

First and second upper mounting members respectively have outboard ends abutting upper ends of the first and second upright brace members and inboard ends secured to the first and second upper cross braces.

First and second lower mounting members respectively have outboard ends abutting lower ends of the first and second upright braces and inboard ends secured to the first and second bottom cross braces.

The novel structure has utility in reinforcing a gate mounted on a level surface and has further utility in enabling mounting of a gate on a non-level surface where the free, swinging end of the gate is positioned above or below the hingedly mounted end.

An important object of this invention is to provide a gate-bracing structure that facilitates mounting of a gate on a slope.

Another object is to provide a gate-bracing structure that is installed on site so that the parts thereof may be cut to fit the exact dimensions of a gate being installed.

Still another object is to provide a gate-bracing structure made of common materials such as wood and aluminum so that the structure is economical to manufacture.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
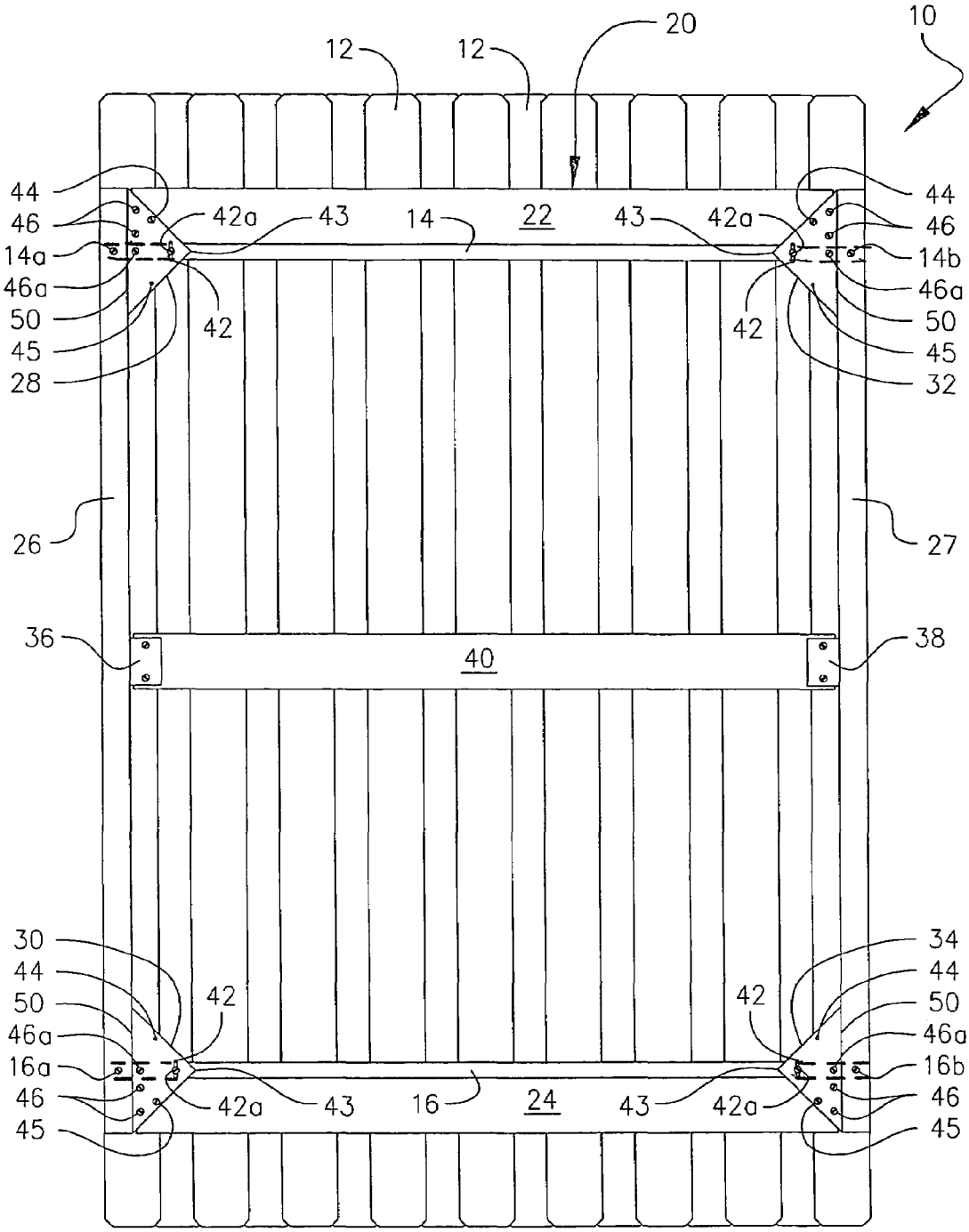
FIG. 1 is a rear elevational view of a first application of the novel frame.
Figure 2:
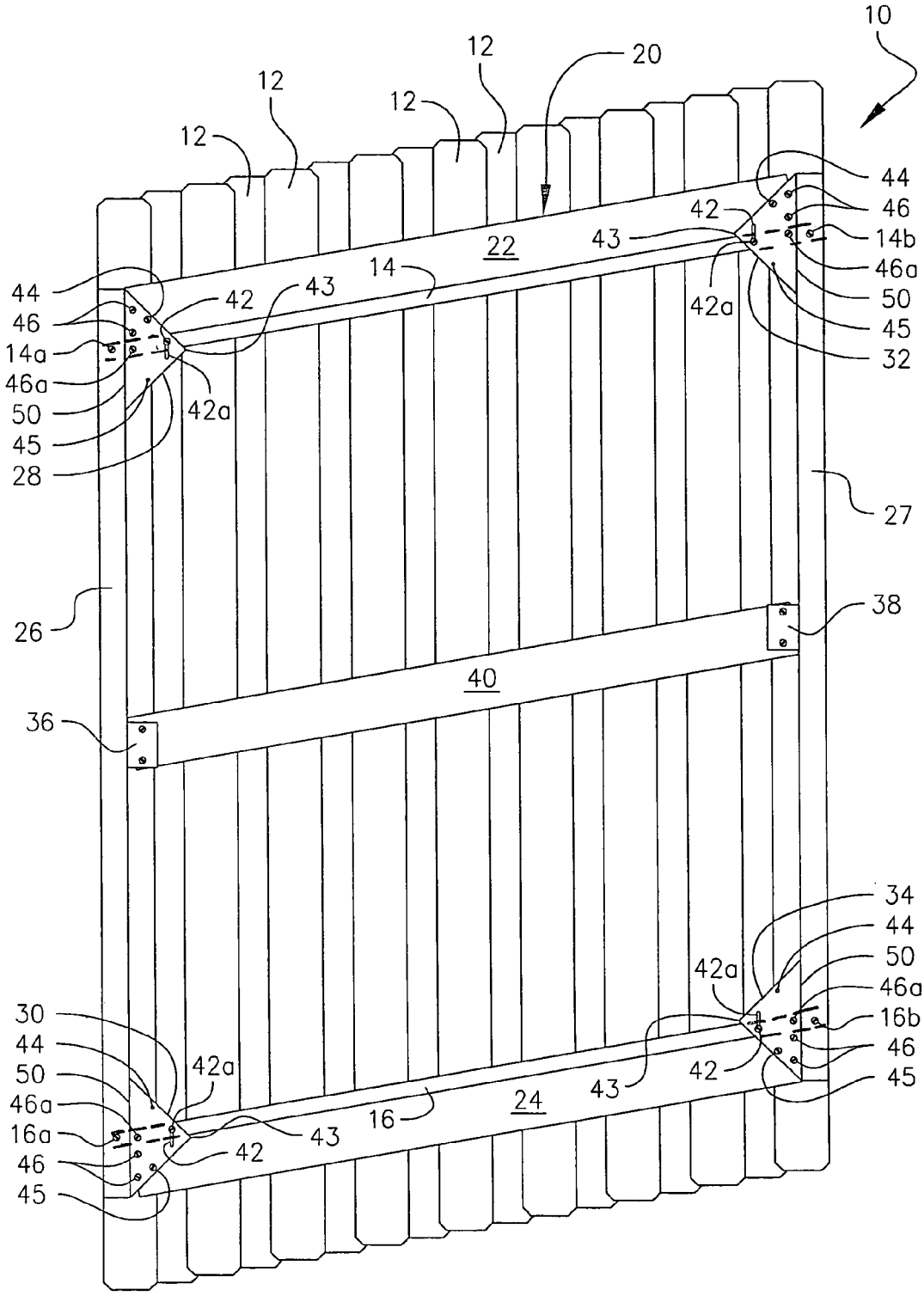
FIG. 2 is a rear elevational view of a second application of the novel frame.

Referring now to FIGS. 1 and 2, it will there be seen that the reference numeral 10 denotes an illustrative embodiment of the present invention as a whole.

In this particular embodiment, the novel frame is used with a gate 10 having a wooden construction. Each individual element of gate 10 is a four inch (4") wide wooden slat 12. The slats overlap one another at their respective vertical edges. The amount of overlap is determined by the gate hardware and the opening desired. Each slat is slideably movable in a vertical plane relative to its contiguous slats. It should therefore be understood that the view of FIG. 1 depicts a gate mounted on level ground and that the view of FIG. 2 depicts the same gate mounted on a slope.

The novel structure that braces gate 10 in both of said configurations is denoted as a whole by the reference numeral 20.

Gate frame 20 includes a first upper cross brace 14 and a first lower cross brace 16, both of which are preferably formed of aluminum. In a preferred embodiment, the dimension of each of said first and second upper cross braces is 1×1×0.90. Each first cross brace 14, 16 has three (3) holes pre-drilled in each of its opposite ends, as explained more fully hereinafter.

Gate frame 20 further includes a second upper cross brace 22 and a second lower cross brace 24, both of which are preferably formed of wood. Second upper cross brace 22 abuts and overlies first upper cross brace 14 and second lower cross brace 24 abuts and underlies first lower cross brace 16.

Left upright brace 26 has an outboard edge that is flush with the left edge of gate 10 and right upright brace 27 has an outboard edge flush with the right side of gate 10. In a preferred embodiment, left and right upright braces 26 and 27 are formed of aluminum.

First upper mounting plate 28 has a triangular configuration and is secured by welding or other suitable means to the upper end of left upright brace 26. First lower mounting plate 30 also has a triangular configuration and is secured by welding or other suitable means to the bottom end of left upright brace 26.

Similarly, second upper mounting plate 32 has a triangular configuration and is secured by welding or other suitable means to the upper end of right upright brace 27. Second bottom mounting plate 34 also has a triangular configuration and is secured by welding or other suitable means to the lower end of right upright brace 27.

First middle mounting plate 36 has a rectangular configuration, an aluminum construction, and is secured by welding or other suitable means to left upright brace 26, mid-length thereof. Second middle mounting plate 38 has a rectangular configuration, an aluminum construction, and is secured by welding or other suitable means to right upright brace 27, mid-length thereof. Middle cross brace 40 is secured at its opposite ends to said first and second middle mounting plates, and is preferably of wooden stricture. However, middle cross brace 40 is used only in gates having a width of about six feet (6'). Said middle cross brace is not needed in gates having widths of four to five feet (4–5').

Each triangular mounting member of this invention has an elongate, vertically-extending adjustment slot 42 formed therein near apex 43. A screw 42*a* is received within each slot 42 and each screw is received within an internally-threaded opening formed in first upper cross brace 14 or first lower cross brace 16 that underlies the triangular mounting member. This enables adjustment of each triangular mounting member relative to its first cross brace 14 or 16. Moreover, the internally-threaded opening for receiving adjustment screw 42*a* is one of the three (3) aforementioned openings formed in each opposite end of said first cross braces 14, 16.

A pair of mounting holes 44, 45 is formed in each triangular mounting member about midway between the base and top thereof, near the opposite edges thereof. Said mounting holes are hereinafter referred to as the mid-height mounting holes.

Note that openings 45 are unused in the upper triangular mounting members 28, 32 and that openings 44 are unused in the lower triangular mounting members 30, 34 of this embodiment. If extra reinforcement is required in an application, a third upper cross brace like second upper cross brace 22 may be added in underlying relation to first upper cross brace 14 and secured to triangular mounting members 28, 32 by screws installed through said openings 45, 45. A reinforcing turnbuckle assembly could also be mounted with its opposite ends secured by screws in said openings 45, 45. Similarly, a third lower cross brace like second lower cross brace 24 may be added in overlying relation to first lower cross brace 16 and secured to triangular mounting members 30, 34 by screws installed through said openings 44, 44. A reinforcing turnbuckle assembly could also be mounted with its opposite ends secured by screws in said openings 44, 44.

Three additional mounting holes are formed in each triangular mounting member near base 50 thereof. One of the mounting holes 46*a* is centered on the axis of symmetry of the triangular mounting member and the other two, collectively denoted 46, are formed on one side of the axis of symmetry in spaced relation to one another. Each mounting hole 46*a* is one of the above-mentioned three (3) holes drilled in each end of first cross braces 14, 16. Mounting holes 46 that are equidistantly spaced from base 50 of the triangular member are hereinafter referred to as the base mounting holes.

As depicted in FIG. 1, the base mounting holes 46 in first upper triangular mounting member 28 and the base mounting holes 46 in second upper triangular mounting member 32 are positioned in overlying relation to second upper cross brace 22 and secured thereto by suitable fasteners that extend through said base mounting holes. The base mounting holes 46 in first lower triangular mounting member 30 and the base mounting holes 46 in the second lower triangular mounting member 34 are positioned in overlying relation to second lower cross brace 24 and secured thereto by suitable fasteners that extend through said base mounting holes. No fastener is placed in mid-height mounting hole 45 in triangular mounting members 28, 32 and no fastener is placed in mid-height mounting hole 44 in triangular mounting members 30, 34 in this illustrated embodiment as aforesaid.

It should also be observed that, in this first embodiment, first upper cross brace 14 has a length equal to the entire width of gate 10. Thus, an opening is formed in left upright brace 26 to receive the left end (as illustrated) of first upper cross brace 14, and an opening is formed in right upright brace 27 to receive the right end (as illustrated) of said first upper cross brace 14, as indicated by the dotted lines. The same structure applies to first lower cross brace 16. Screws in mounting holes 14*a*, 14*b* secure the opposite ends of first upper cross brace 14 to left upright brace 26 and right upright brace 27. Screws in mounting holes 16*a*, 16*b* secure the opposite ends of first lower cross brace 16 to left upright brace 26 and right upright brace 27. These screws are the third screws in the above-mentioned three (3) screws formed in each end of said first cross braces.

Figure 3:
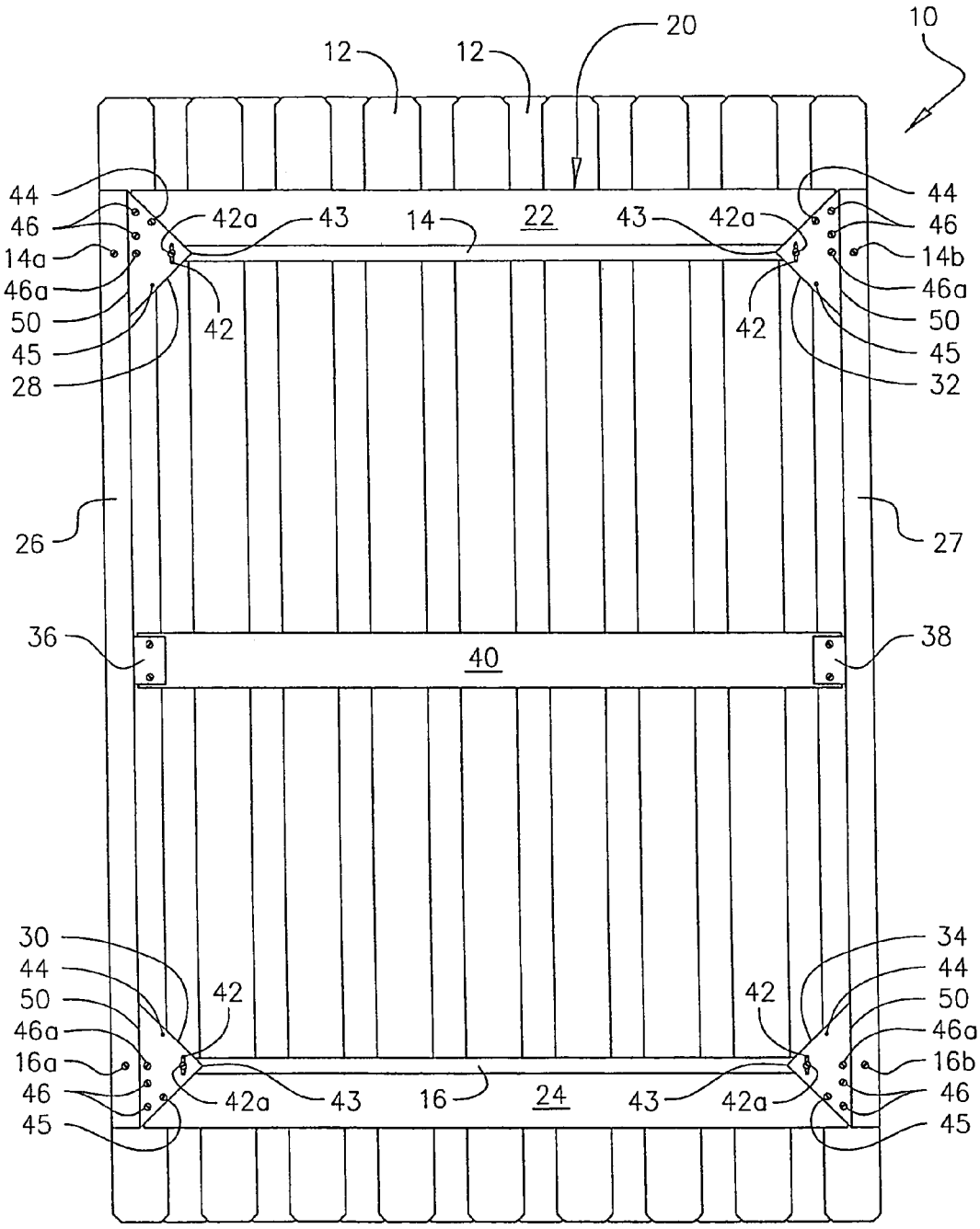
FIG. 3 is a rear elevational view of a third application of the novel frame.
Figure 4:
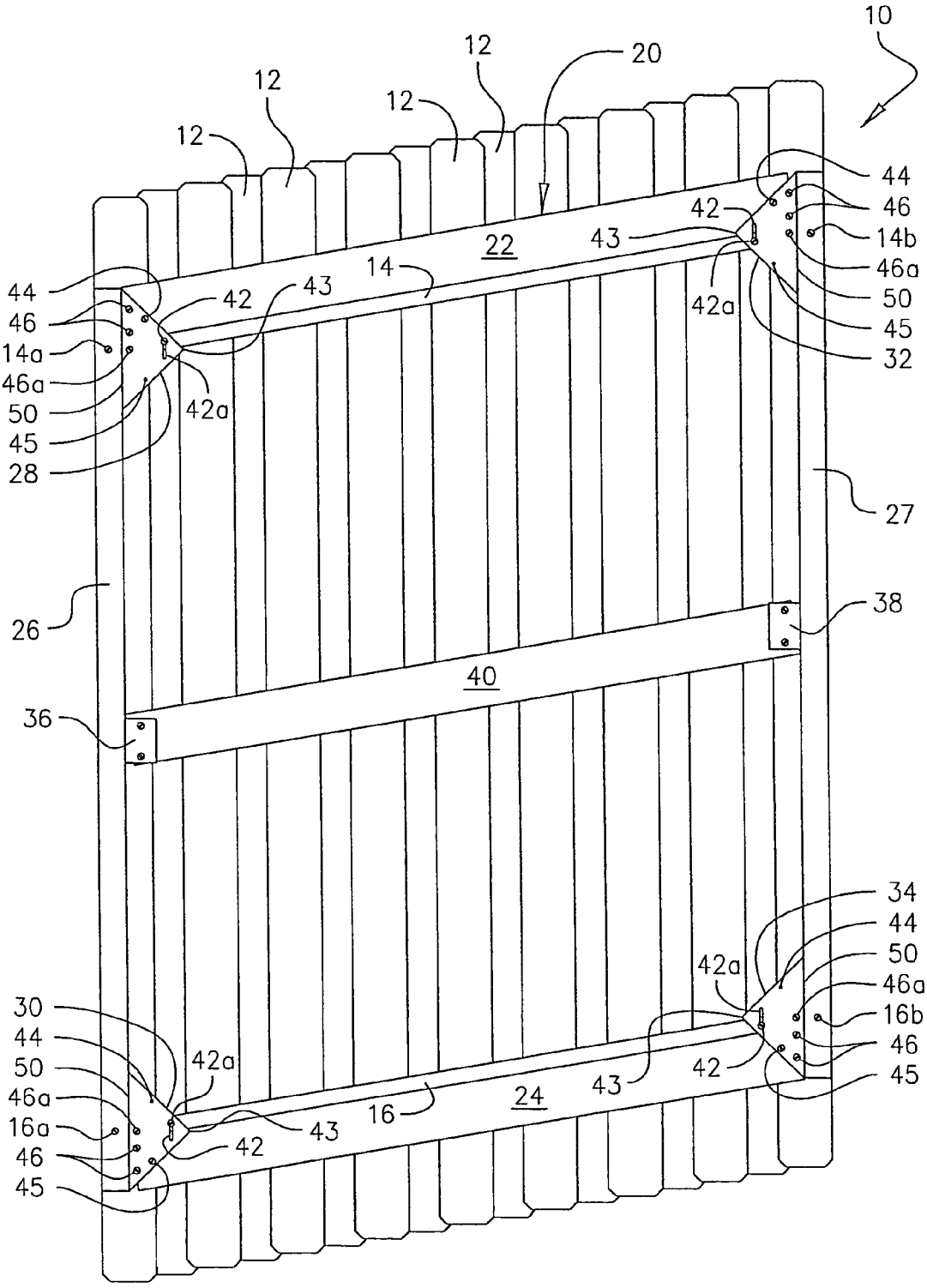
FIG. 4 is a rear elevational view of a fourth application of the novel frame.

However, instead of extending all the way to the edges of gate 10, first cross braces 14, 16 could extend only to left and right upright braces 26 and 27. This second embodiment is depicted in FIGS. 3 and 4. Accordingly, there are no openings formed in the inboard sides of upright braces 26, 27 in this second embodiment and the opposite ends of first cross braces 14, 16 abut said left and right upright braces 26, 27. This reduces the strength of the novel brace system but such arrangement is within the scope of this invention.

If the novel frame is to be used on a level gate, as depicted in FIGS. 1 and 3, apex 43 of each triangular mounting member is placed in horizontal relation to its opposing counterpart and all fasteners are tightened. Since wood and aluminum are both easily cut in the field, aluminum cross braces 14, 16, and wooden cross braces 22, 24 (and 40 if needed) are cut to size on site. Upright aluminum brace members 26 and 27 are about one and one-half inches (1.5") in width and they are positioned on gate 10 so that their respective outboard edges are flush with the outboard edges of the gate. Accordingly, aluminum cross braces 14, 16 and wooded cross braces 22, 24 and 40 (if used) are cut to have a length that is about three inches (3") less than the width of gate 10.

From FIGS. 1 and 3 it should be understood that the novel gate-bracing structure has utility where a gate is mounted on level ground. The novel structure clearly reinforces the gate so that it can endure loads if applied thereto.

The embodiment of FIGS. 2 and 4 includes the same parts as the embodiment of FIGS. 1 and 3, but the respective flat ends of the aluminum and wooden cross braces of FIGS. 1 and 3 are cut at an angle so that the opposite ends of said cross braces squarely abut upright braces 26 and 27. Accordingly, the angle cut into the left end of said cross braces forms an acute angle and the angle cut into the right end of said cross braces forms an obtuse angle relative to the bottom edge of each cross brace when the free, swinging end of the gate is higher the hinged end thereof. The angle cut into the left end of said cross braces forms an obtuse angle and the angle cut into the right end of said cross braces forms an acute angle relative to the bottom edge of each cross brace when the free, swinging end of the gate is lower the hinged end thereof. In FIGS. 2 and 4 the right side of gate 10 is elevated with respect to the left side thereof to enable mounting of the gate on a slope. In this example, the right side of gate 10 is elevated twelve inches (12") higher than the left side thereof. In the industry, this is known as twelve inches of rackability. After wooden slats 40 have been moved with respect to one another so that gate 10 is distorted into the configuration depicted in FIGS. 2 and 4, the aluminum and wooden cross braces are cut as needed. After installation, all fasteners are tightened and novel frame 20 holds the gate in said racked configuration.

It should be understood that the right side of the gate could also be lower than the left side as mentioned earlier.

Thus it should be understood that the elongation of each adjustment slot 42 enables opposing apices 43 of opposing triangular mounting members to be mis-aligned from one another when the gate and hence frame 20 is in its FIG. 2, FIG. 4 or other non-level configuration. The fastener in adjustment slot 43 formed in upper left triangular mounting member 28 is positioned at the upper end of said slot, and the fastener in adjustment slot 43 formed in upper right triangular mounting member 32 is positioned at the lower end of said slot. The same positions are noted with respect to triangular mounting members 30, 34 in this particular orientation of the novel gate frame.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

What is claimed is:

1. A gate having a frame for bracing the gate, comprising:

said gate having a first, hingedly mounted end and a second, free end that swings with respect to said first, hingedly mounted end;

a first upright brace having an outboard edge positioned flush to a first vertical edge of said gate;

a second upright brace having an outboard edge positioned flush to a second vertical edge of said gate, said second vertical edge being laterally spaced from said first vertical edge by a width of said gate;

a first upper cross brace having a length substantially equal to a width of said gate;

said first and second upright braces each having an opening formed therein to receive opposite ends of said first upper cross brace therein;

a second upper cross brace having a first end that abuts said first upright brace near an upper end thereof and a second end that abuts said second upright brace near said upper end thereof;

said first upper cross brace disposed in abutting, underlying relation to said second upper cross brace;

a first lower cross brace having a length substantially equal to a width of said gate;

said first and second upright braces each having an opening formed therein to receive opposite ends of said first lower cross brace therein;

a second lower cross brace having a first end that abuts said first upright brace near a lower end thereof and a second end that abuts said second upright brace near a lower end thereof;

said first lower cross brace disposed in abutting, overlying relation to said second lower cross brace;

a first upper mounting member having an outboard end that abuts said first upright brace near said upper end thereof, and having an inboard end that overlies and is secured to said first and second upper cross braces;

a second upper mounting member having a base that abuts said second upright brace near said upper end thereof, and having an inboard end that overlies and is secured to said first and second upper cross braces;

a first lower mounting member having a base that abuts said first upright brace near said lower end thereof, and having an inboard end that overlies and is secured to said first and second lower cross braces;

a second lower mounting member having a base that abuts said second upright brace near said lower end thereof, and having an inboard end that overlies and is secured to said first and second lower cross braces;

said first and second upright braces, said first upper cross brace, and said first lower cross brace being formed of aluminum;

said first upper cross brace and said first lower cross brace being cut to length to substantially equal the width of said gate;

said second upper cross brace and said second lower cross brace being cut to length to fit between said first and second upright braces;

said gate being formed of a plurality of upright slats;

each of said slats being slideably mounted with respect to its contiguous slats so that a second slat may be slightly elevated with respect to a first slat at a hinged end of said gate, a third slat may be slightly elevated with respect to the second slat, and so on until a last slat at the free, swinging end of the gate is elevated substantially higher or lower than said first slat at said hinged end thereof;

said first upper cross brace, said first lower cross brace, said second upper cross brace and said second lower cross brace each having square cut opposite ends when said first slat at said hingedly mounted end of said gate and said last slat at said free, swinging end of the gate, and all intermediate slats are collectively disposed at a substantially common level so that the gate is installed on a substantially level slope;

said first upper cross brace, said first lower cross brace, said second upper cross brace, and said second lower cross brace each having a first end having an acute angle cut formed therein when said last slat is elevated relative to said first slat; and said first upper cross brace, said first lower cross brace, said second upper cross brace, and said second lower cross brace each having a second end having an obtuse angle cut formed therein when said last slat is elevated relative to said first slat.

2. The frame of claim 1, further comprising:

said first upper cross brace, said first lower cross brace, said second upper cross brace and said second lower cross brace each having a first end having an obtuse angle cut formed therein when said last slat is positioned at a lower elevation relative to said first slat;

said first upper cross brace, said first lower cross brace, said second upper cross brace and said second lower cross brace each having a second end having an acute angle cut formed therein when said last slat is positioned at said lower elevation relative to said first slat.

3. The frame of claim 1, further comprising:

a first middle mounting member secured to said first upright brace about mid-length thereof;

a second middle mounting member secured to said second upright brace about mid-length thereof; and a middle cross brace having a first end secured to said first mounting member and a second end secured to said second mounting member.

4. The frame of claim 1, further comprising:

said first and second upper mounting members and said first and second lower mounting members having a triangular configuration.

5. The frame of claim 3, further comprising:

said middle cross brace having square cut opposite ends when a first slat at said hingedly mounted end of the gate and a last slat at said free, swinging end of the gate, and all intermediate slats are collectively disposed at a substantially common level so that the gate is installed on a substantially level slope.

6. The frame of claim 3, further comprising:

said middle cross brace having a first end having an acute angle cut formed therein when a last slat at said free, swinging end of said gate is elevated relative to said first slat;

said middle cross brace having a second end having an obtuse angle cut formed therein when said last slat is elevated relative to said first slat.

7. The frame of claim 3, further comprising:

said middle cross brace having a first end having an obtuse angle cut formed therein when a last slat at said free, swinging end of said gate is positioned at a lower elevation than said first slat;

said middle cross brace having a second end having an acute angle cut formed therein when said last slat is positioned at a lower elevation relative to said first slat.

8. The frame of claim 4, further comprising:

an elongate, vertically extending slot formed in an apex of each of said first and second upper mounting members and said first and second lower mounting members.

9. The frame of claim 8, further comprising:

an aperture formed in each of said first and second upper mounting members and said first and second lower mounting members coincident with an axis of symmetry thereof.

10. The frame of claim 9, further comprising:

a plurality of apertures formed in each of said first and second upper mounting members and said first and second lower mounting members near said base of said mounting members on a common side of said aperture formed coincident with said axis coincident with said axis of symmetry.

* * * * *